US007837486B2

(12) United States Patent
Li

(10) Patent No.: US 7,837,486 B2
(45) Date of Patent: Nov. 23, 2010

(54) EJECTION DEVICE FOR A CONNECTOR

(75) Inventor: Jin-Fei Li, Hsin-Tien (TW)

(73) Assignee: Advanced Connectek Inc., Hsin-Tien (TW)

( * ) Notice: Subject to any disclaimer, the term of this patent is extended or adjusted under 35 U.S.C. 154(b) by 594 days.

(21) Appl. No.: 11/850,724

(22) Filed: Sep. 6, 2007

(65) Prior Publication Data

US 2008/0064239 A1 Mar. 13, 2008

(30) Foreign Application Priority Data

Sep. 8, 2006 (TW) ..... 95216060 U

(51) Int. Cl.
*H01R 13/62* (2006.01)

(52) U.S. Cl. ..... 439/159

(58) Field of Classification Search ..... 439/159, 439/160, 630, 152, 153, 155, 67
See application file for complete search history.

(56) References Cited

U.S. PATENT DOCUMENTS

| | | | | |
|---|---|---|---|---|
| 5,655,917 | A * | 8/1997 | Kaneshige et al. | 439/155 |
| 6,413,106 | B1 * | 7/2002 | Yu | 439/159 |
| 2006/0049233 | A1 * | 3/2006 | Menon | 228/8 |
| 2006/0148322 | A1 * | 7/2006 | Matsukawa et al. | 439/630 |

* cited by examiner

*Primary Examiner*—Alexander Gilman
(74) *Attorney, Agent, or Firm*—Rabin & Berdo, P.C.

(57) ABSTRACT

An ejection device is manufactured independently from but implemented with a subscriber identification module (SIM) connector comprising an insulative housing and a tray having a SIM card mounted therein and has a bracket, a push button, a link and an ejection lever. The push button is mounted slidably on the bracket. The link is mounted slidably on the bracket and is connected with the push button. The ejection lever is mounted pivotally to the bracket, is connected with the link and selectively pushes the SIM card out of the tray. The ejection device may be pre-fabricated or formed with the connector so can be easily retrofitted to current designs or added simply to any SIM card connector and greatly facilitates SIM card removal while benefiting from reduced production costs from simplification and greater economies of scale.

12 Claims, 6 Drawing Sheets

EJECTION DEVICE FOR A CONNECTOR

BACKGROUND OF THE INVENTION

1. Field of the Invention

The present invention relates to an ejection device, and more particularly to an ejection device that is manufactured independent from and implemented with a subscriber identity module (SIM) connector having a tray used to accommodate a SIM card to conveniently eject the SIM card.

2. Description of Related Art

Subscriber identity card (SIM) connectors are used in numerous electronic devices such as cellular phones, and personal data assistants to accommodate and hold a SIM card that records a user's identification information. International standards have been designated for dimension and shape of the SIM cards so the connectors must correspond to these, but ejection devices for SIM card connectors may be designed at each manufacturer's desire. Therefore, manufacturers are free to develop various holding and ejection devices for SIM card connectors. However, some systems are very awkward to use and may damage the SIM card. A conventional connector comprises an insulative housing including an ejection device formed integrally with the insulative housing as a single piece. However, manufacturing ejection-integrated device is difficult so production of the ejection-integrated connector is slow and expensive, resulting in higher cost of the connector and prevents economies of scale from being efficiently applied. Also ejection-device-integrated connectors are inflexible and must be designed around, preventing easy application and retrofitting to current designs.

To overcome the shortcomings, the present invention provides an ejection device to mitigate or obviate the aforementioned problems.

SUMMARY OF THE INVENTION

The main objective of the invention is to provide an ejection device that is manufactured independently from and implemented with a subscriber identity module (SIM) connector having a tray used to mount a SIM card to conveniently eject the SIM card.

An ejection device in accordance with the present invention is manufactured independently from but implemented with a subscriber identity module (SIM) connector comprising an insulative housing and a tray having a SIM card mounted therein and has a bracket, a push button, a link and an ejection lever. The push button is mounted slidably on the bracket. The link is mounted slidably on the bracket and is connected with the push button. The ejection lever is mounted pivotally to the bracket, is connected to the link and selectively pushes the SIM card out of the tray. The ejection device may be pre-fabricated or formed with the connector so can be easily retrofitted to current designs or added simply to any SIM card connector and greatly facilitates SIM card removal whilst benefiting from reduced production costs from simplification and greater economies of scale.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
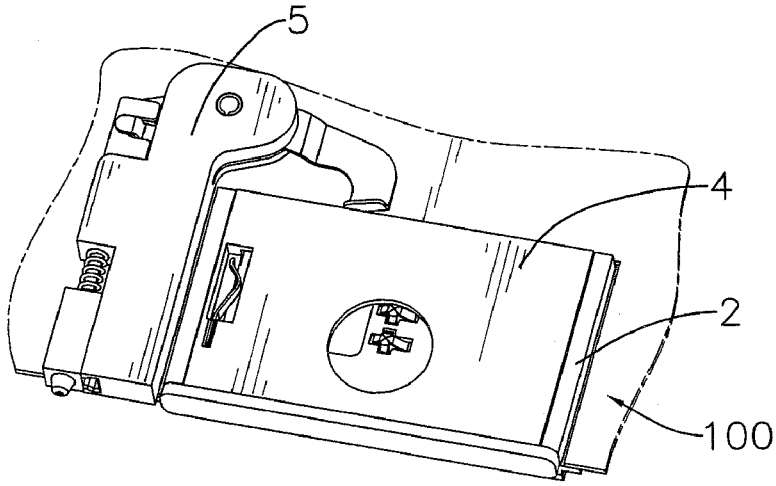
FIG. 1 is a perspective view showing an ejection device in accordance with the present invention and a connector mounted on a printed circuit board.
Figure 2:
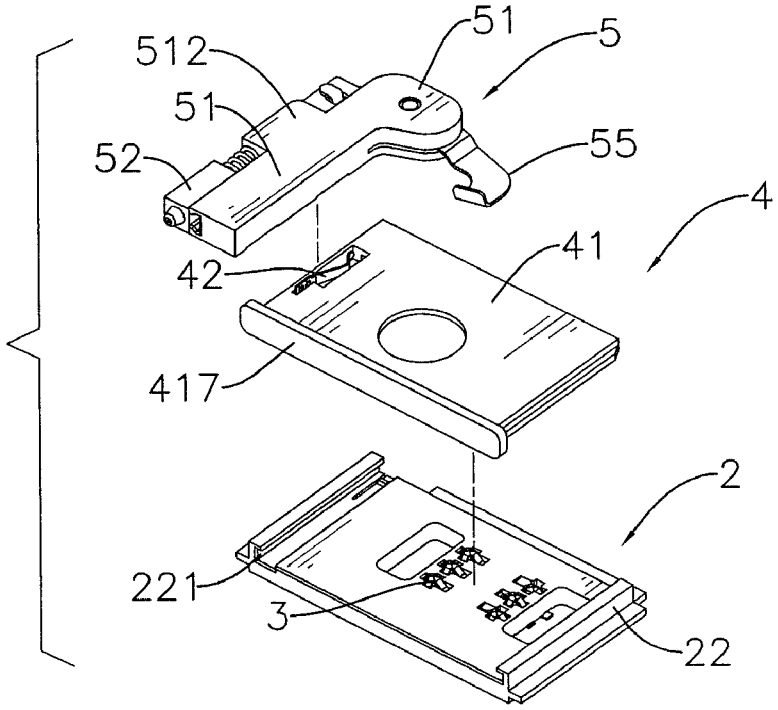
FIG. 2 is a partially exploded, top perspective view of the connector with the ejection device in FIG. 1.
Figure 3:
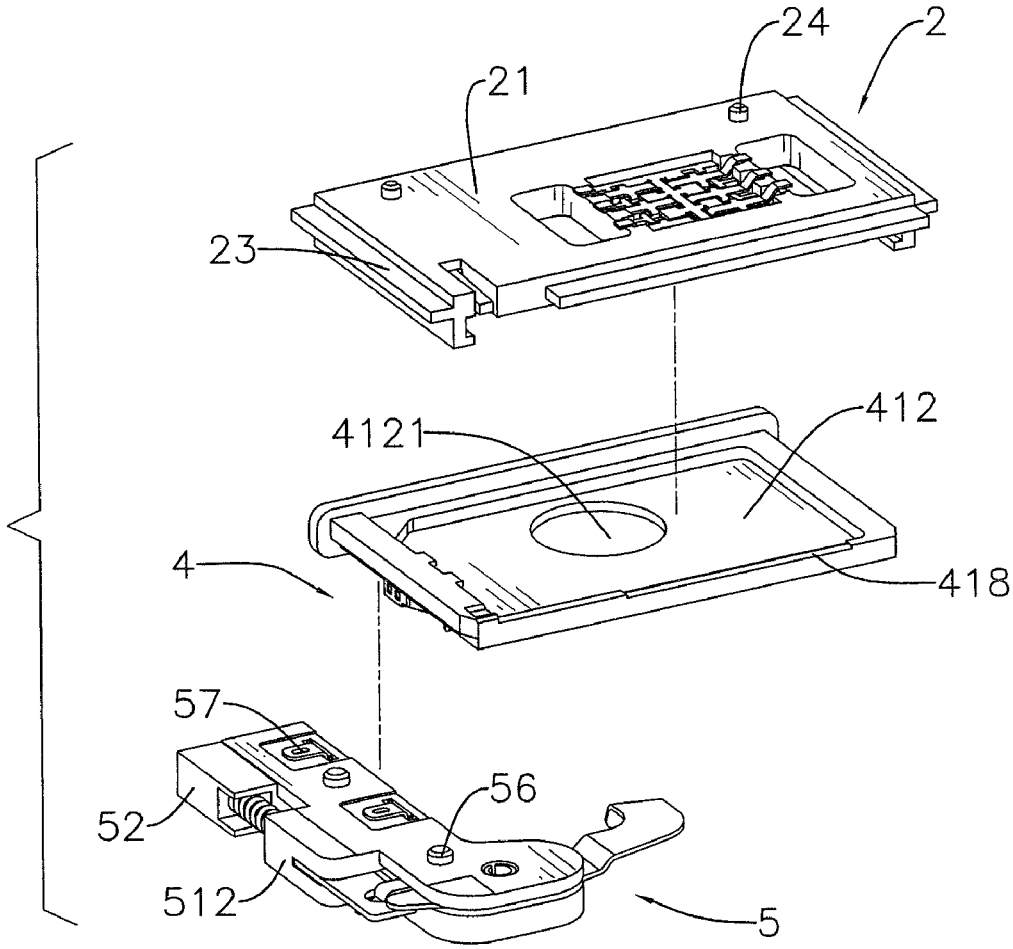
FIG. 3 is a partially exploded, bottom perspective view of the connector with the ejection device in FIG. 1.

With reference to FIGS. 1 to 3, an ejection device (5) is used with a subscriber identify module (SIM) connector to hold a SIM card and has an insulative housing (2), a plurality of terminals (3) and a tray (4).

Figure 5:
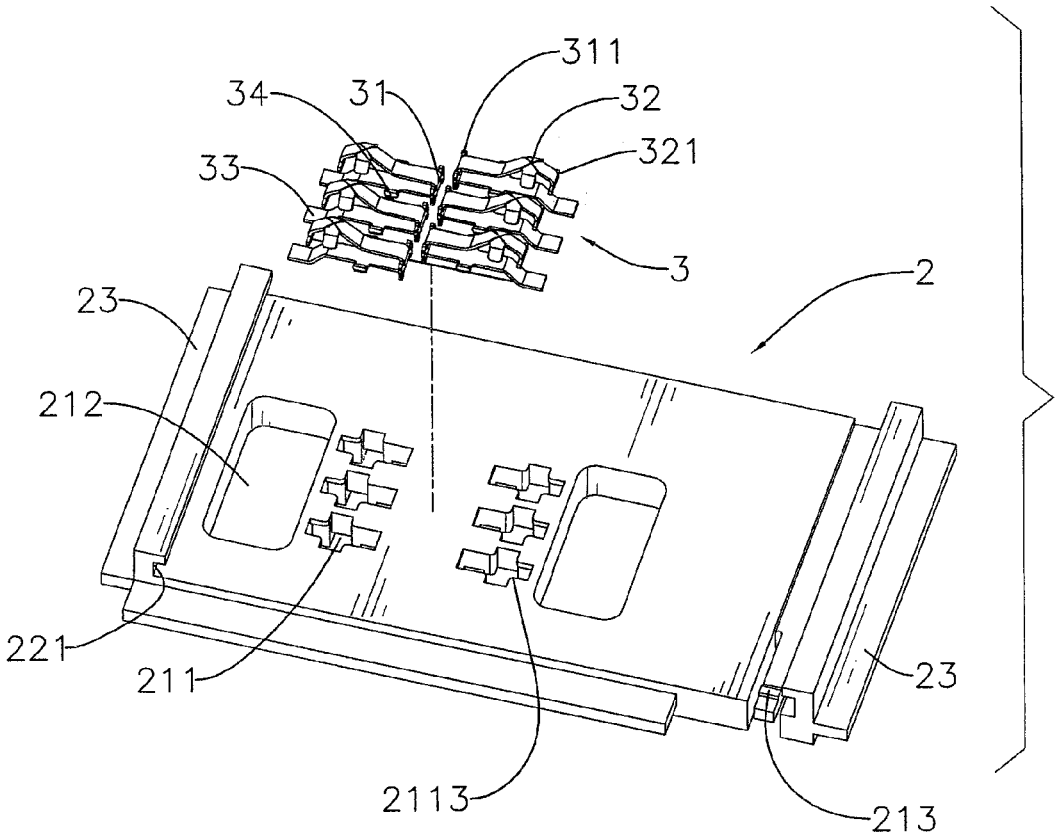
FIG. 5 is an enlarged perspective view of the connector in FIG. 4.

With further reference to FIG. 5, the insulative housing (2) may be mounted on a printed circuit board (PCB) and has a bottom (21), two opposite sidewalls (22), a plurality of mounting holes (211), a plurality of openings (212), a positioning protrusion (213), a pair of strips (23) and a plurality of mounting posts (24).

Figure 4:
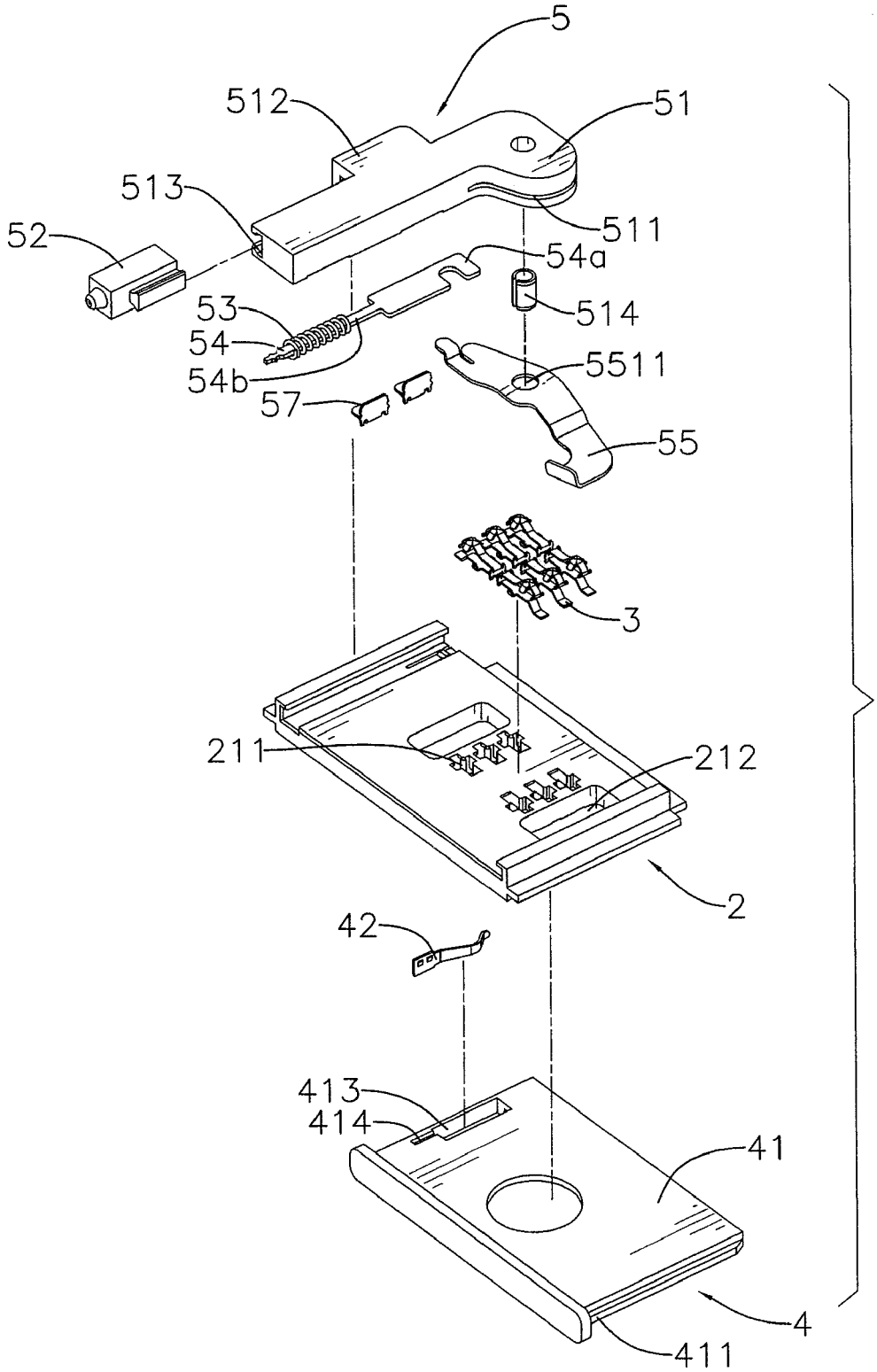
FIG. 4 is an exploded perspective view of the connector along with the ejection device in FIG. 2.
Figure 6:
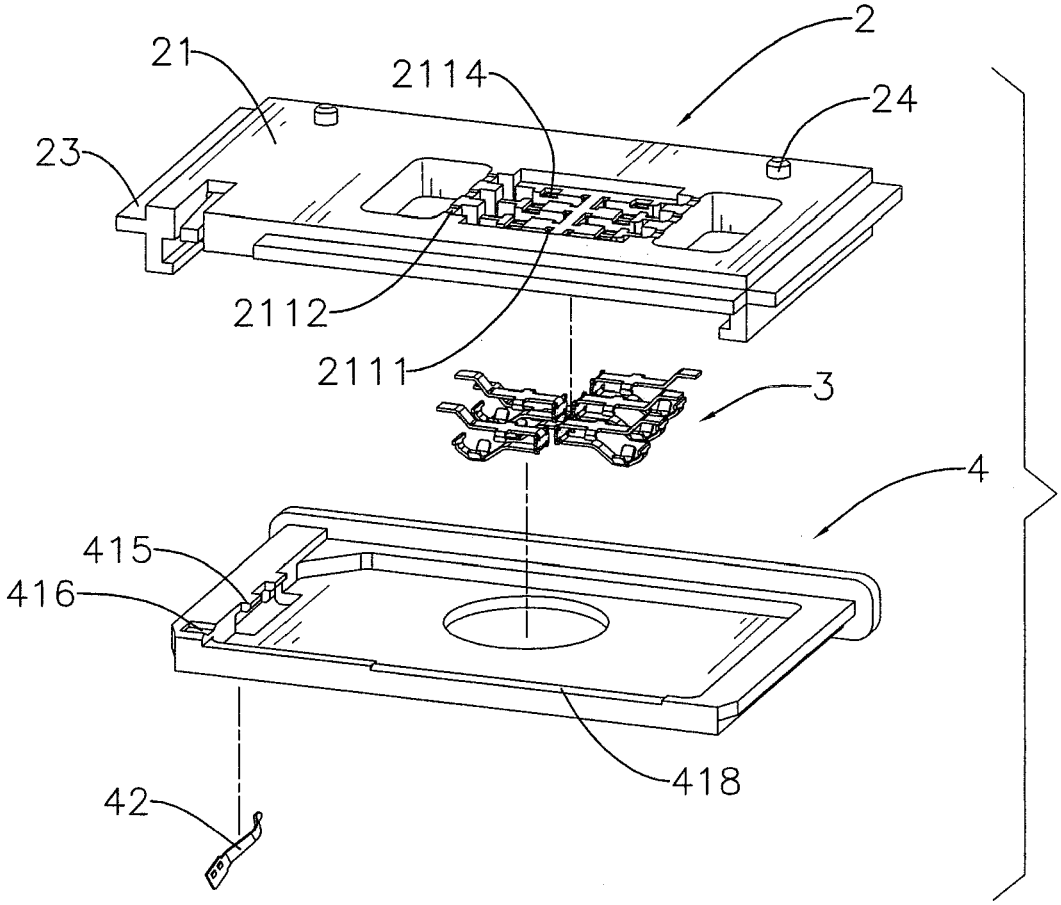
FIG. 6 is an enlarged exploded perspective view of the connector in FIG. 4.

With further reference to FIGS. 4 and 6, the bottom (21) of the insulative housing (2) has an inner surface and an outer surface.

The sidewalls (22) are formed on and protrude up from the inner surface of the bottom (21). Each sidewall (22) has a track slot (221) defined in the sidewall (22).

A space is defined in the insulative housing (2) between the sidewalls (22).

The mounting holes (211) are cross-shaped, are defined through the bottom (21). Each mounting hole (211) has a longitudinal section, a transverse section, a mounting slot (2111), a soldering recess (2112) and a pair of wing recesses (2114). The longitudinal section is located perpendicular to the sidewall (22) and has two ends. The transverse section perpendicularly intersects the longitudinal section and has two ends. The mounting slot (2111) is defined in the outer surface of the bottom (21) respectively at one end of the longitudinal section. The soldering recess (2112) is defined in the outer surface of the bottom (21) at the other end of the longitudinal section and has a pair of hook mounts (2113) formed on the inner surface. The wing recesses (2114) are defined in the outer surface of the bottom (21) respectively at the ends of the transverse section.

The openings (212) are defined through the bottom (21) and communicate with the mounting holes (211).

The positioning protrusion (213) is formed on and protrudes from the inner surface of the bottom (21).

The strips (23) are formed on and protrude respectively from the sidewalls (22) and are used to mount the SIM card connector on the PCB.

The mounting posts (24) are formed on and protrude from the outer surface of the bottom (21) and are mounted on the PCB.

The terminals (3) are electrically conductive, are made of metal, correspond to and are mounted respectively in the mounting holes (211) and electrically connect detachably to contact terminals on the SIM card to allow data and power to be transmitted between the SIM card and the PCB. Each terminal (3) has a mounting portion (31), a contacting portion (32), a soldering portion (33) and a pair of fastening portions (34).

The mounting portion (31) is mounted in the mounting slot (2111) in a corresponding mounting hole (211) in the bottom (21) and has a pair of fastening protrusions (311). The fastening protrusions (311) are formed on and protrude from the mounting portion (31) and are mounted in the mounting slot (211) to prevent movement of the terminals (3). The contacting portion (32) is resilient, is formed on and protrudes from the mounting portion (31), is mounted in and protrudes out from the mounting holes (211) in the bottom (21) of the insulative housing (2) and has a hook (321). The hook (321) is formed on and protrudes from the contacting portion (32) and is mounted on the hook mount (2113).

The soldering portion (33) is formed on and protrudes from the mounting portion (31), is mounted in the soldering recess (2112) in the corresponding mounting hole (211) and is soldered onto the PCB to form a secure electrical connection.

The wings (34) are formed on and protrude from soldering portion (33) and are mounted respectively in the wing recesses (2114) in the corresponding mounting hole (211) to hold the terminals in place.

The tray (4) is mounted detachably in the insulative housing (2), may accommodate the SIM card and has a body (41) and a resilient tab (42).

The body (41) is detachably mounted slidably in the space of the insulative housing (2). The body (41) has a front edge, a rear edge, two opposite sides, a pair of lips (411), a cavity (412), a tab slot (413), a tab recess (414), a pair of retaining tabs (415), a positioning recess (416), a stopper (417) and a guide (418).

The lips (411) are formed respectively on, protrude respectively from the sides and are slidably mounted respectively in the track slots (221) in the sidewalls (22) of the insulative housing (2).

The cavity (412) is defined in the body (41), accommodates and holds the SIM card.

The tab slot (413) is defined through the body (41) and communicates with the cavity (412).

The tab recess (414) is defined in the body (41) and communicates with the tab slot (413).

The retaining tabs (415) are formed on and protrude from the body (41), correspond to the tab slot (413) and securely retain the SIM card in the cavity (412).

The positioning recess (416) is defined in the body (41) and engages selectively with the positioning protrusion (213) on the bottom (21) of the insulative housing (2) to hold the tray (4) securely in the insulative housing (2).

The stopper (417) is formed on the front edge and selectively abuts against the insulative housing (2) to prevent the tray (4) from sliding too far into the insulative housing (2).

The guide (418) is formed on the rear edge and is tapered to form two inclined surfaces. The inclined surfaces smoothly guide the contacting portions (32) of the terminals (3) on the insulative housing (2) into the cavity (412) to contact the terminals of the SIM card in the cavity (412).

The resilient tab (42) is mounted in the tab slot (413), tightly presses the SIM card to prevent the SIM card from moving and has a proximal end mounted securely in the tab recess (414).

Figure 7:
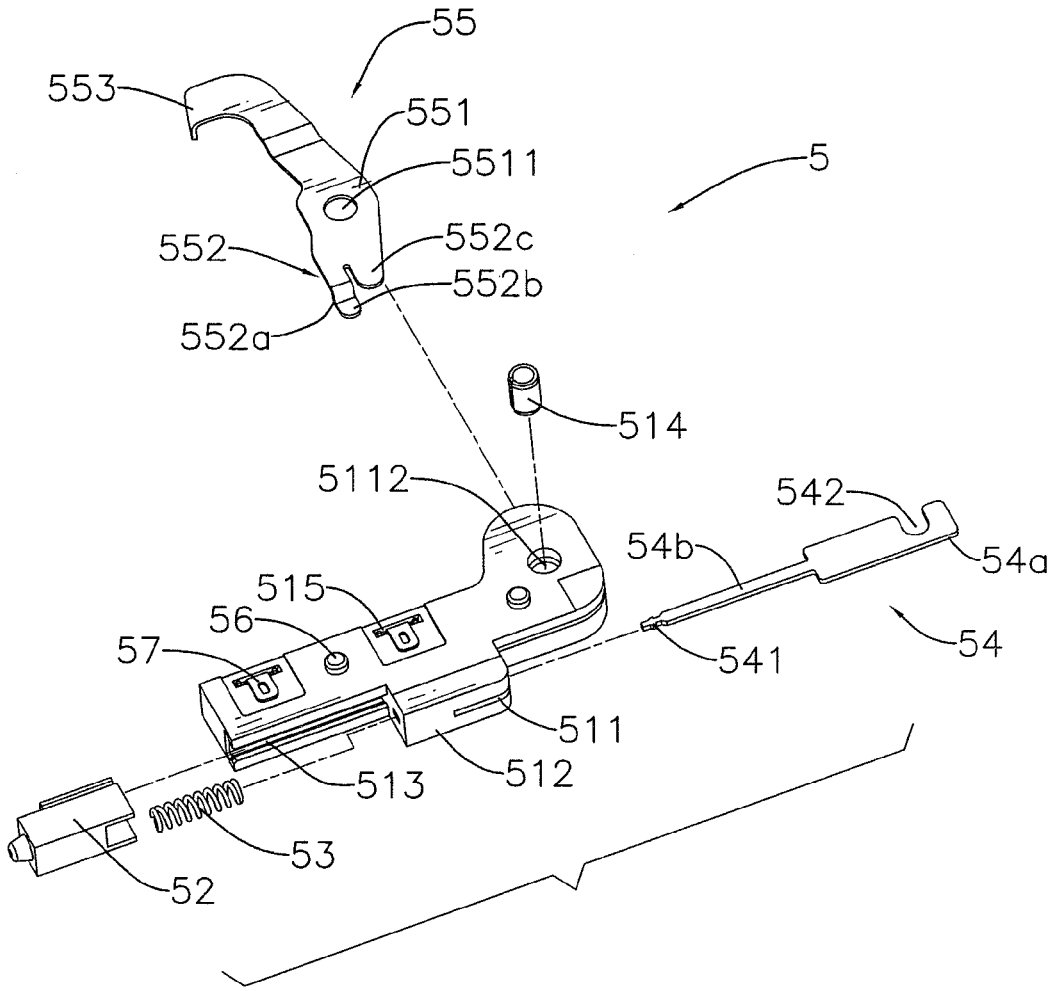
FIG. 7 is an enlarged exploded perspective view of the ejection device in FIG. 4.

With further reference to FIG. 7, the ejection device (5) is manufactured separately from and mounted adjacent to the connector (100) and may be pre-fabricated before mounting. The ejection device comprises a bracket (51), a push button (52), a link (54) and an ejection lever (55) and may further have a biasing member (53).

The bracket (51) may be L-shaped, may be mounted on the PCB and is located adjacent to one sidewall (22) of the insulative housing (2). The bracket (51) has a top surface, a bottom surface, a side surface, an activating end, a pivoting end, a mounting block (512) and a slit (511) and may further have a keyed guide (513), a pivot hole (5112), a pivot pin (514), a plurality of retaining passages (515), a plurality of soldering members (57) and a plurality of mounting posts (56).

The side surface is defined between the top and bottom surfaces. The pivoting end is opposite to the activating end. The mounting block (512) is formed on and protrudes transversely from the side surface of the bracket (51) and may have a mounting bore. The mounting bore is defined longitudinally through the mounting block (512). The slit (511) is defined transversely through the pivoting end to define a flat void separating the top and bottom surfaces and at the pivoting end, and may be defined partially in the mounting block (512). The keyed guide (513) is defined longitudinally in the activating end in the side surface and may be a trapezoid cross section. The pivot hole (5112) is defined through the pivoting end of the bracket (51) and may communicate with the slit (511). The pivot pin (514) is mounted in the pivot hole (5112). The retaining passages (515) are defined in the bottom surface of the bracket (51). The soldering members (57) are securely mounted respectively in the retaining passages (515) and are soldered onto the PCB to secure the bracket (51) on the PCB. The mounting posts (56) are formed on and protrude from the bottom surface and are mounted in the PCB.

The push button (52) is mounted slidably on the bracket (51), selectively abuts the mounting block (512) and may have a slide. The slide is formed on and protrudes from the push button (52), corresponds to and is mounted slidably in the keyed guide (513), may have a trapezoid cross section corresponding to that of the guide rail (513) to allow the push button (52) to be held securely in and slide easily in the bracket (51).

The link (54) is mounted slidably in the bracket (5), may be through the mounting block (512), is connected with the push button (52) and has a main portion (54*a*), an elongated portion (54*b*) and a notch (542). The main portion (54*a*) may be mounted slidably in the slit (511) in the mounting block (512) and selectively abuts the mounting block (512). The elongated portion (54*b*) is formed on and protrudes from the main portion (54*a*), is mounted slidably through the mounting block (512) and may be mounted slidably through the mounting bore of the mounting block (512). The elongated portion (54*b*) has a proximal end connected with the main portion (54*a*) and a distal end mounted securely in the push button (52). The notch (542) may be semicircular and is defined in the main portion (54*a*).

The ejection lever (55) is mounted pivotally on the bracket (51), is connected pivotally with the link (54), may be in the slit (511) in the bracket (51) and has a body segment (551), a connecting segment (552) and an ejecting segment (553). The body segment (551) is mounted rotatably in the slit (511) and may further have a pivot bore (5511). The pivot bore (5511) is defined through the body segment (551) and is mounted rotatably around the pivot pin (514) in the pivot hole (5112) of the bracket (51). The connecting segment (552) is forked, is formed on and protrudes from the body segment (551), is connected with the link (54) and has a connecting prong and a retaining prong (552*c*). The connecting prong stepped, is formed on and protrudes from the connecting segment (552) and has an upright section (552*a*) and a retaining section (552*b*). The upright section (552*a*) is formed on and protrudes perpendicularly from the connecting segment (552) and is mounted rotatably in the notch (542) in the link (54). Therefore, when the ejection lever (55) pivots, the link (54) slides. The retaining section (552*b*) is formed on and protrudes perpendicularly from the upright section (552*a*). The retaining prong (552*c*) is formed on and protrudes from the connecting segment (552) at an interval from the retaining section (552*b*) to define a retaining slot located between the retaining section (522*b*) and the retaining prong (552*c*). The retaining slot holds the main portion (54*a*) of the link (54) to prevent the upright section (552*a*) of the ejection lever (55) from detaching from the notch (542) of the link (54). The ejection segment (553) may be L-shaped, is formed on and protrudes from the body segment (551) and selectively pushes and ejects the tray (4) with the SIM card out of the space of the insulative housing (2).

The biasing member (53) is a resilient element winding around the elongated portion (54*b*) of the link (54) between the push button (52) and the mounting block (512) of the bracket (51) to force the push button (52) and the mounting block (512) apart when no external force is applied to the push button (52). In this embodiment, the biasing member (53) is substantially a spiral spring.

To eject the tray (4) with the SIM card out of the insulative housing (2), a user pushes the push button (52). The link (54) is moved by the push button (52) and drives the connecting segment (552) to pivot around the pivot pin (514), thereby forcing the ejecting portion (553) to rotate and eject the SIM card out of the insulative housing (2).

The ejection device (5) is separate from the connector (100) and is pre-fabricated before cooperating in conjunction with the connector (100) instead of formed integrally to the connector (100). Therefore, the ejection device (5) may be added to conventional connectors with minimal or no redesign or integrated with conventional connectors simply after a design period, thereby improving products ending their development phase or even retrofitted to current models and may therefore take advantage of economies of scale to reduce costs whilst improving SIM card ejection.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A device for ejecting a card in a connector having an insulative housing and a tray for accommodating the card, the device comprising:

a bracket having
- a top surface;
- a bottom surface;
- a side surface defined between the top and bottom surfaces;
- an activating end;
- a pivoting end opposite to the activating end; and
- a mounting block formed on and protruding transversely from the side surface of the bracket;

a push button mounted slidably on the bracket;

a link mounted slidably in the bracket, connected securely with the push button, mounted slidably through the mounting block and having
- a main portion selectively abutting against the mounting block;
- an elongated portion formed on and protruding from the main portion, mounted slidably through the mounting block and having a proximal end connected with the main portion and a distal end mounted securely in the push button; and a notch defined in the main portion; and an ejection lever mounted pivotally on the bracket, connected pivotally with the link, adapted to push and eject the tray out of the insulative housing of the connector and having
- a body segment mounted rotatably in the bracket;
- an ejection segment formed on and protruding from the body segment; and
- a connecting segment formed on and protruding from the body segment, being forked and having
  - an upright section formed on and protruding perpendicularly from the connecting segment and mounted rotatably in the notch in the link;
  - a retaining section formed on and protruding perpendicularly from the upright section; and
  - a retaining prong formed on and protruding from the connecting segment at an interval from the retaining section to define a retaining slot located between the retaining section and the retaining prong and holding the main portion of the link.

2. The device as claimed in claim 1, wherein the bracket further has a slit defined transversely through the pivoting end to define a flat void separating the top and bottom surfaces at the pivoting end; and the body segment of the ejection lever is mounted rotatably in the slit.

3. The device as claimed in claim 2, wherein the slit is further defined partially in the mounting block; and the main portion of the link is slidably mounted in the slit in the mounting block.

4. The device as claimed in claim 3, wherein the mounting block further has a mounting bore formed longitudinally through the mounting block; and the elongated portion of the push button is mounted through the mounting bore.

5. The device as claimed in claim 4 further comprising a biasing member being resilient, mounted around the elongated portion of the link between the push button and the mounting block of the bracket to force the push button and the mounting block apart.

6. The device as claimed in claim 5, wherein the biasing member is a spiral spring.

7. The device as claimed in claim 1, wherein the bracket further has
- a pivot hole defined through the pivoting end of the bracket; and
- a pivot pin mounted in the pivot hole; and the ejection lever further has a pivot bore defined through the body segment and mounted rotatably around the pivot pin.

8. The device as claimed in claim 1, wherein the bracket further has a keyed guide defined longitudinally in the activating end in the side surface of the bracket; and the push button has a slide formed on and protruding from the push button and mounted slidably in the keyed guide.

9. The device as claimed in claim 8, wherein the keyed guide is a trapezoid cross section; and the slide of the push button is a trapezoid cross section corresponding to that of the keyed guide.

10. The device as claimed in claim 1, wherein the bracket further has a plurality of retaining passages defined in the bottom surface of the bracket; and a plurality of soldering members securely mounted respectively in the retaining passages.

11. The device as claimed in claim 1, wherein the bracket further has a plurality of mounting posts formed on and protruding from the bottom surface of the bracket.

12. The device as claimed in claim 1, wherein the ejection segment is L-shaped.

* * * * *